US005407252A

United States Patent [19]

Perero

[11] Patent Number: 5,407,252

[45] Date of Patent: Apr. 18, 1995

[54] METHOD AND APPARATUS FOR SCALING MINE ROOFS AND RIBS

[75] Inventor: Huey P. Perero, New Iberia, La.

[73] Assignee: Carey Salt Company, Inc., Lydia, La.

[21] Appl. No.: 299,597

[22] Filed: Sep. 1, 1994

[51] Int. Cl.[6] ..... E21C 27/01; E21C 37/26

[52] U.S. Cl. ..... 299/10; 15/93.1; 29/81.16; 299/70; 299/88

[58] Field of Search ..... 299/10, 36, 38, 69, 299/70, 88, 94, 29; 29/81.11, 81.16; 125/8, 38, 39, 43; 15/93.1, 236.01; 172/445.1

[56] References Cited

U.S. PATENT DOCUMENTS 4,871,214 10/1989 Pradelle ..... 299/69
5,028,092 7/1991 Loski ..... 299/69 X

FOREIGN PATENT DOCUMENTS 1051195 3/1979 Canada ..... 299/70
785457 12/1980 U.S.S.R. ..... 299/29

*Primary Examiner*—David J. Bagnell
*Attorney, Agent, or Firm*—Robert N. Montgomery

[57] ABSTRACT

A mine scaling tool having a base plate to which a collar is concentrically attached on one side and appropriately supported with gusseted rib plates. A relatively long, heavy walled tube is telescopically fitted within a reenforcing collar. The tube is cut at an oblique angle of approximately 15 degrees off vertical in the frontal plane at the end opposite the collar. A face plate is centrally positioned over the open end of the tube and adequately reenforced with gusseted rib plates and reenforcing bars. Picks are attached parallel to the face plate along all sides extending outwardly from the edges, thereby serving as tines.

10 Claims, 3 Drawing Sheets

METHOD AND APPARATUS FOR SCALING MINE ROOFS AND RIBS

BACKGROUND OF THE INVENTION

1. Field of the Invention

This invention relates to mining implements in general and more particular to the scaling or flaking operation involved with the removal of loose materials from the roof and ribs of salt mine caverns and passages.

2. General Background

Mine scaling is a safety-related job generally practiced in all underground mining operations. When an ore body is removed the passages and caverns remaining have a natural tendency to "close in" as a result of the surrounding geologic pressure. Mining operators go to great lengths to shore-up the roofs and walls of the passages to prevent "cave-ins." Since it is impractical to totally encase such caverns and passages, the geologic pressure exerted between the supports causes a spalling phenomena which results in loose material clinging to the mine's roof and walls (ribs). This loose material called flakes or scales falls at unpredictable times, thus being a hazard to men and equipment and often causing serious injury or severe damage to equipment. This problem is most acute in salt mines as a result of the very large caverns and reduced anchoring and shoring capability.

To prevent accidents from falling debris mine personnel routinely remove loose materials from the mine's roof and walls (ribs) through an operation called "scaling." In some cases scaling involves putting laborers on platform lifts whereby pry bars and pneumatic hammers are used to chip and gouge in any suspicious cracks or spalled areas. In more resent instances sophisticated mechanized equipment utilizing extendable boom cranes with hydraulically operated "fingers" or pneumatic hammers have been used. Others have employed boom vehicles with rotating chains to simply beat the loose material from the roof.

The equipment and methods discussed above are labor intensive, expensive or require dedicated equipment which is often expensive to maintain or impractical to use in the harsh environment of mines.

SUMMARY OF THE PRESENT INVENTION

The present invention is basically a boom or rigid tool with tines at one end designed to be attachable to standard mine tractor equipment, such as front-end loaders and the like, via quick couplings. The working end is fitted with teeth-like picks similar to those used on bucket loaders. The tractor vehicle elevates the boom to contact the roof or walls and simply travels forward scraping away any loose material in its path. This arrangement has several unique advantages. The tool is simple to construct and maintain and requires no special equipment to operate. Manpower is reduced to a minimum with less exposure to the hazards of falling materials. The time of performing the required scaling operation is reduced to a minimum.

Therefore, it is an object of the present invention to provide a scaling tool which is vehicle mountable and can be easily removed and attached to any suitable vehicle.

A further object is to provide an inexpensive scaling tool which allows scaling while moving, thus making the tool up to ten times faster than other scaling operations.

It is also an object of the invention to minimize the manpower required to perform scaling operations.

BRIEF DESCRIPTION OF THE DRAWINGS

The present invention will be better understood by reference to the following detailed description of a preferred embodiment of the present invention and the accompanying drawings in which.

DETAILED DESCRIPTION OF THE PREFERRED EMBODIMENT

Figure 1:
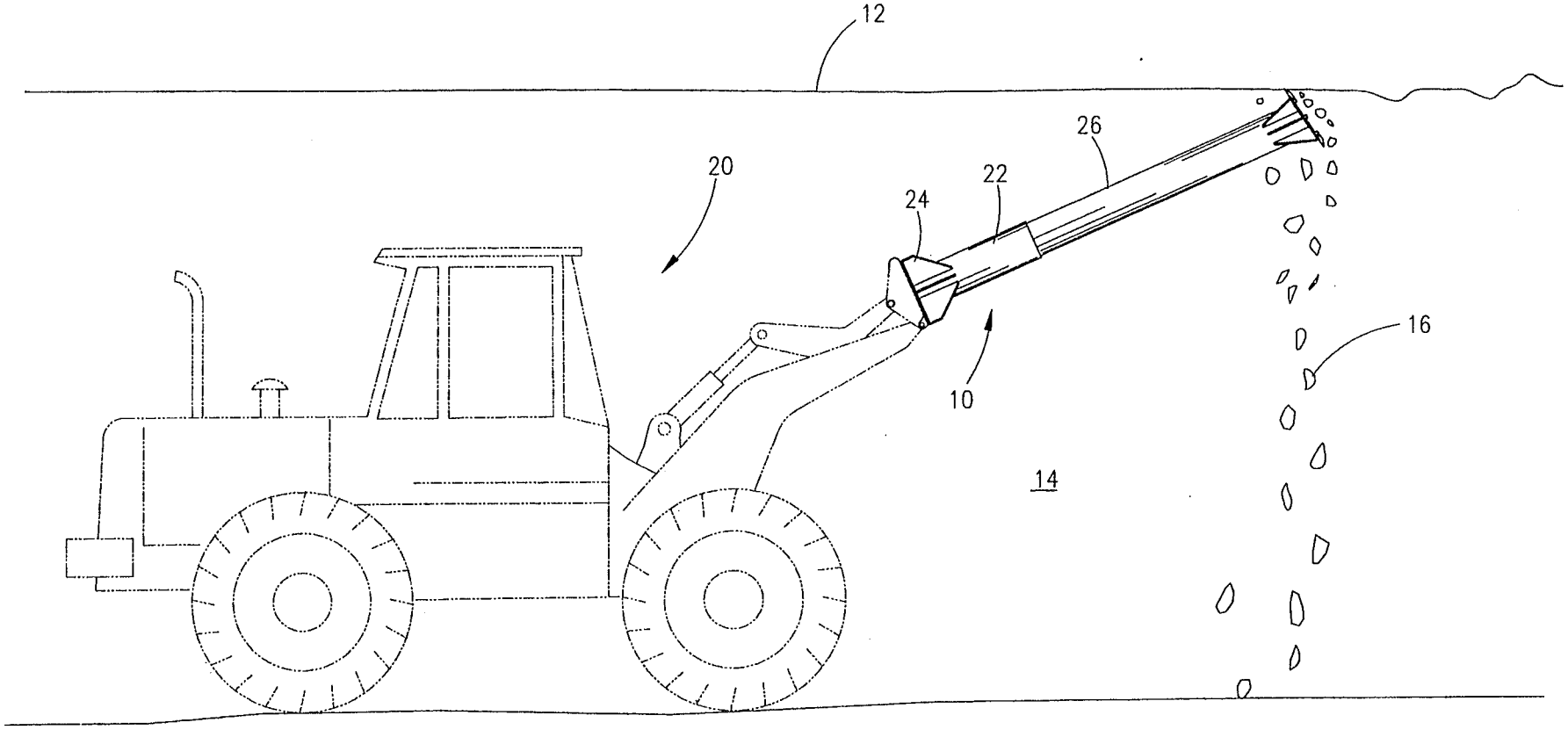
FIG. 1 is an elevation of the preferred embodiment mounted on a tractor loader.

The preferred embodiment of the scaling tool 10 is shown attached via a standard tractor loading hitch to a front end loader tractor 20 in FIG. 1. The tractor 20 raises and positions the scaling tool 10 in contact with the roof 12 or wall of a mine cavern or passage. By moving the tractor 20 forward or backwards, the tool 10 is scraped along the roof 12 or wall 14 thereby dislodging any loose material 16. The tractor 20 can just as easily raise or lower the tool 10 as needed to scrap a wall 14 or shelf parallel or perpendicular to the tool. The scaling tool 10 is mounted to the tractor 20 via a standard quick coupling normally associated with such attachment hooks.

Figure 1A:
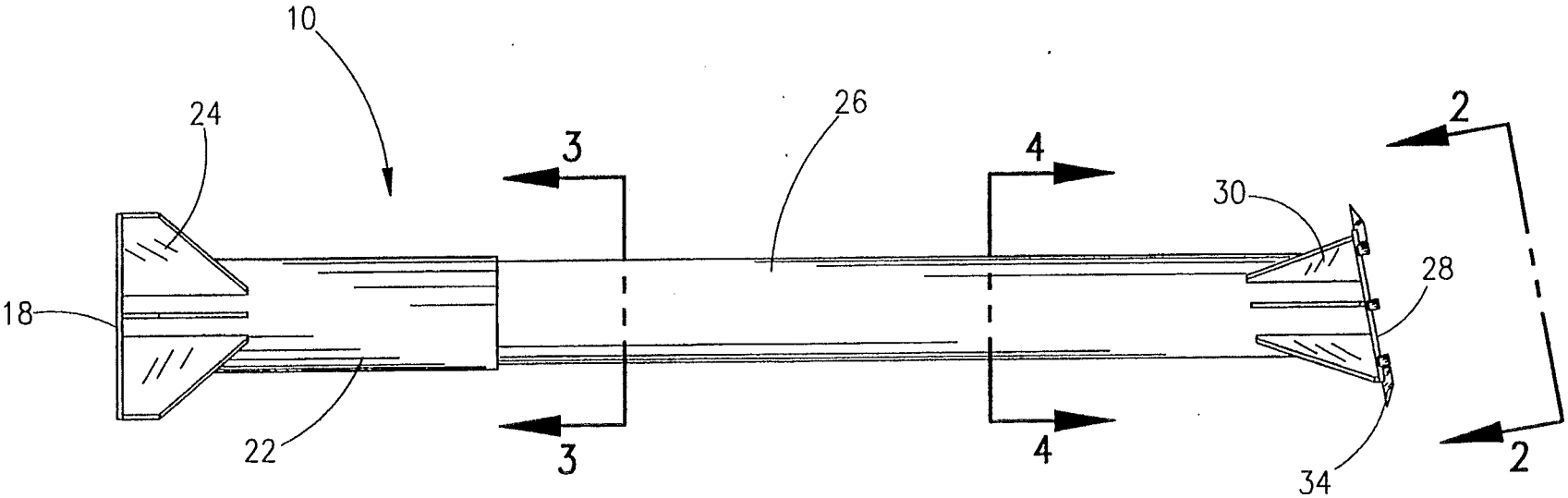
FIG. 1*a* is a front elevation view of the preferred embodiment.
Figure 2:
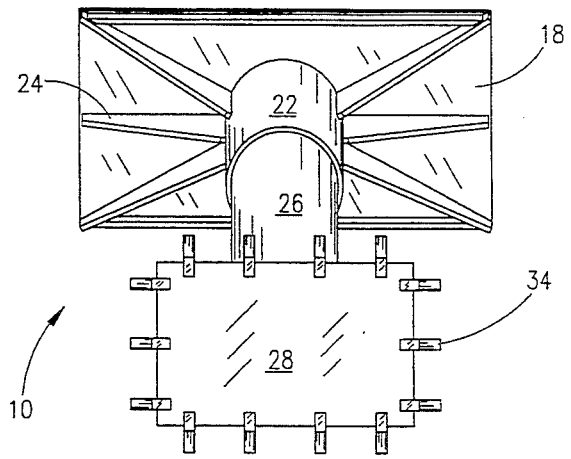
FIG. 2 is an end view of the preferred embodiment taken along sight line 2—2 in FIG. 1(*a*)
Figure 3:
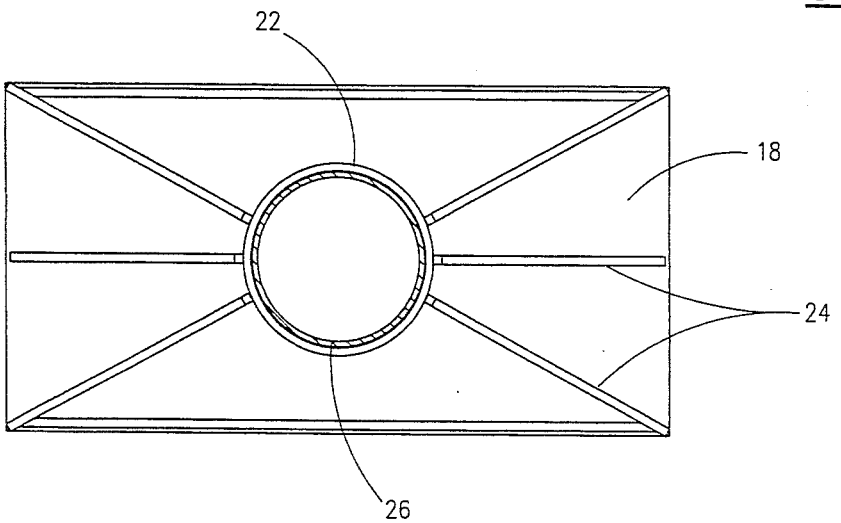
FIG. 3 is a cross section view taken along sight line 3—3 in FIG. 1*a*.
Figure 4:
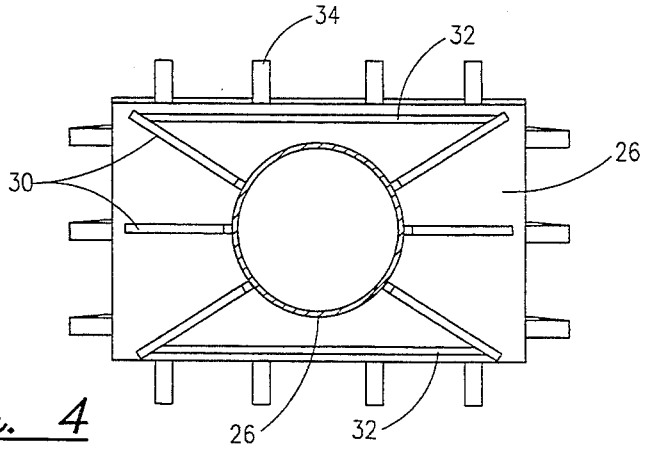
FIG. 4 is a cross section view taken along sight line 4—4 in FIG. 1*a*.

The scaling tool 10 as shown in FIG. 1*a* is a rigid, tubular column and is of all welded construction comprising a base plate 18 to which a collar 22 is concentrically attached to one side and appropriately supported by vertical gussets or rib plates 24. A relatively long, heavy walled tubular column 26 is telescopically fitted, as depicted in FIG. 3, within the reinforcing collar 22. The tubular column 26 is cut at an oblique angle of approximately 15 degrees off vertical, in the frontal plane, at the end opposite the collar 22. A face plate 28 as seen in FIG. 2 is centrally positioned over the open end of the tubular column 26 and adequately reenforced with gusseted rib plates 30 and reenforcing bars 32 as shown in FIG. 4. Picks 34 are attached parallel to the face plate 28 along all sides extending outwardly from the edges thereby serving as tines.

What is claimed is:

1. A tractor mounted, mine scaling tool comprising:

a) a base plate;

b) a tubular column attached perpendicular to said base plate;

c) a face plate attached perpendicular to said tubular column opposite said base plate; and d) a plurality of picks attached parallel to said face plate, extending outwardly beyond said face plate.

2. A tractor mounted, mine scaling tool according to claim 1 wherein said tubular column further comprises a tubular collar reinforcement for a portion of its length.

3. A tractor mounted, mine scaling tool according to claim 2 wherein said tubular collar is structurally supported with rib gussets appropriately placed around said base plate attached to said tubular collar.

4. A tractor mounted, mine scaling tool according to claim 3 wherein said base plate is attachable to a tractor via standard loader hitch.

5. A tractor mounted, mine scaling tool according to claim 4 wherein said face plate is attached to said tubular column at an oblique angle.

6. A tractor mounted, mine scaling tool according to claim 5 wherein said face plate is symmetrically oriented with said base plate.

7. A tractor mounted, mine scaling tool comprising:

a) a base plate;

b) a reenforced tubular column, attached perpendicular to said base plate, vertically supported by rib gussets;

c) a reenforced face plate, symmetrically orientated with said base plate, attached obliquely to said tubular column, opposite said base plate; and d) a plurality of picks attached parallel to said face plate, extending outwardly beyond said face plate.

8. A tractor mounted, mine scaling tool according to claim 7 wherein said reenforced tubular column is reinforced with a tubular collar for a portion of its length.

9. A tractor mounted, mine scaling tool according to claim 8 wherein said base plate is attachable by quick couplings to a tractor loader hitch.

10. A method of mine scaling comprising the steps of:

a) mounting a rigid tool having tines extending therefrom to a tractor loader;

b) positioning said rigid tool in contact with a mine's roof or wall;

c) driving said tractor loader forwards and backwards while maintaining contact with said roof or wall;

d) dislodging loose material from said roof or walls of said mine; and e) repeating steps a–d until all loose material is dislodged.

* * * * *